US009026306B2

(12) United States Patent
Wu et al.

(10) Patent No.: US 9,026,306 B2
(45) Date of Patent: May 5, 2015

(54) DATA ACQUISITION DEVICE FOR A VEHICLE

(71) Applicant: Wistron NeWeb Corporation, Hsinchu (TW)

(72) Inventors: Yi-Cheng Wu, Hsinchu (TW); San-Yi Kuo, Hsinchu (TW); Chao-Chun Lin, Hsinchu (TW); Chih-Fen Yang, Hsinchu (TW)

(73) Assignee: Wistron Neweb Corporation, Hsinchu (TW)

( * ) Notice: Subject to any disclaimer, the term of this patent is extended or adjusted under 35 U.S.C. 154(b) by 0 days.

(21) Appl. No.: 14/506,701

(22) Filed: Oct. 6, 2014

(65) Prior Publication Data

US 2015/0025736 A1 Jan. 22, 2015

Related U.S. Application Data

(63) Continuation-in-part of application No. 13/846,815, filed on Mar. 18, 2013, now abandoned.

(30) Foreign Application Priority Data

Oct. 30, 2012 (TW) ..... 101220966 U

(51) Int. Cl.
*G07C 5/08* (2006.01)
*G07C 5/00* (2006.01)

(52) U.S. Cl.
CPC ..... *G07C 5/0858* (2013.01); *G07C 5/085* (2013.01); *G07C 5/08* (2013.01); *G07C 5/008* (2013.01); *G07C 5/0841* (2013.01)

(58) Field of Classification Search
CPC ..... G07C 5/0858; G07C 5/08; G07C 5/0841; G07C 5/085; G07C 5/008
See application file for complete search history.

(56) References Cited

U.S. PATENT DOCUMENTS

| | | | |
|---|---|---|---|
| 6,832,141 | B2 | 12/2004 | Skeen et al. |
| 7,113,127 | B1 | 9/2006 | Banet et al. |
| 7,530,823 | B1 | 5/2009 | Thornton et al. |
| 7,771,075 | B2 | 8/2010 | Luyckx et al. |
| 8,451,188 | B2 | 5/2013 | Won et al. |
| 2008/0255718 | A1 | 10/2008 | Tuff |
| 2011/0227709 | A1 | 9/2011 | Story |
| 2011/0313593 | A1 | 12/2011 | Cohen et al. |
| 2014/0067195 | A1 | 3/2014 | James et al. |

*Primary Examiner* — Michael J Zanelli
(74) *Attorney, Agent, or Firm* — CKC & Partners Co., Ltd.

(57) ABSTRACT

A data acquisition device for a vehicle includes a first body and a second body. A first body includes a first casing, an antenna member, and two cushion pads. A terminal of the first casing forms a recession and two lateral walls of the recession have two pivot members. The antenna member is disposed in the first casing. The two cushion pads are respectively located on the two lateral walls of the recession and circumferentially disposed around the two pivot members. Each of the cushion pads has a core hole and the pivot members are respectively passing through the core holes. The second body includes a second casing and a process device. A terminal of the second casing has a plug part, and the second casing respectively have two pivot holes pivoted on the two pivot members. The processing device is disposed in the second casing.

10 Claims, 6 Drawing Sheets

DATA ACQUISITION DEVICE FOR A VEHICLE

RELATED APPLICATIONS

This application is a Continuation-in-part of U.S. application Ser. No. 13/846,815, filed on Mar. 18, 2013, which claims priority of Taiwanese Application Serial Number 101220966, filed Oct. 30, 2012, which is herein incorporated by reference.

BACKGROUND

1. Technical Field

The present invention relates to a data acquisition device. More particularly, the present invention relates to a data acquisition device for a vehicle.

2. Description of Related Art

Recently, a device for data acquisition of a vehicle has been widely applied, in particular in an on-board diagnostics (OBD) system of the vehicle. The OBD system may monitor and control the vehicle condition and serve an error code to technicians such that the maintenance technicians are able to check the error parts and characters quickly and correctly by the error code. Nonetheless, the vehicle information needs to be captured, read and diagnosed on a special table of the maintenance factory in order to judge a condition of the vehicle.

Now, the data acquisition device for monitoring the condition of the vehicle is matched with a wireless communication, such that an error condition of the vehicle can be broadcasted through internet and to the driver in real time so as to prevent from a breakdown of the vehicle and enhance the driving safety.

The traditional data acquisition device is usually disposed in front of a driver's seat below a steering wheel and near a throttle pedal or a brake pedal. When the driver moves his legs in driving, the driver may knock the acquisition device to damage it or even get hurt himself. In order to address the forgoing issues, the acquisition device may be designed to be adjustable and rotatable to accommodate to the various types of the vehicles. However, the acquisition device with adjustable and rotatable mechanisms needs more parts so as to increase the manufacturing cost. In addition, the acquisition device may suffer from insufficient securing force, and thus slack from the vehicle due to the vibration of steering the vehicle, noise producing and wearing along the rotating position.

Therefore, there is a need to develop a data acquisition device for a vehicle that is capable of avoiding the foregoing disadvantages.

SUMMARY

In accordance with the present invention, a data acquisition device for a vehicle includes a first body and a second body. A first body includes a first casing, an antenna member, and two cushion pads. A terminal of the first casing forms a recession and two lateral walls of the recession have two pivot members. One of the pivot members is hollow and has a passage. The antenna member is disposed in the first casing for processing a wireless signal. The two cushion pads are respectively located on the two lateral walls of the recession and circumferentially disposed around the two pivot members. Each of the cushion pads has a core hole and the pivot members are respectively passing through the core holes. The second body includes a second casing and a process device. A terminal of the second casing has a plug part for being connected to a vehicle body, and two lateral walls of the second casing respectively have two pivot holes for being pivoted on the two pivot members such that the second casing is capable of rotating along an axis. The passage is communicated with the inner space of the second casing via the corresponding pivot hole. The processing device is disposed in the second casing for being electrically connected to the antenna member and the vehicle body.

According to another embodiment disclosed herein, the second casing has at least one locating hole circumferentially disposed around the two pivot holes, and the first casing has at least one locating member circumferentially disposed around the two pivot members for being rotatably connected with the pivot holes.

According to another embodiment disclosed herein, each of the cushion pads has several through holes circumferentially disposed around the core hole such that the locating members pass through the through holes.

According to another embodiment disclosed herein, the cushion pads have several cushion-locating members circumferentially disposed around the core holes for being connected with the locating holes.

According to another embodiment disclosed herein, each of the cushion pads is a rubber cushion pad or a silicon rubber cushion pad.

According to another embodiment disclosed herein, each of the cushion pads is combined with the second casing in a manner of dual injection molding.

According to another embodiment disclosed herein, the first casing is a plastic casing.

According to another embodiment disclosed herein, the second casing is a plastic casing.

According to another embodiment disclosed herein, the plug part is adapted for an on-board diagnostics (OBD) system or an on-board diagnostics 2 (OBD 2) system.

According to another embodiment disclosed herein, the antenna member is a laser direct structure (LDS) antenna member.

Thus, when the plug part of the second body is coupled with the vehicle body, a rotatable angle between the first body and the second body may be adjusted according to a user demand. The cushion pads circumferentially disposed near the pivot members may serve the cushion to against the shock when the vehicle body is driven and to lower the noise when the first body rotates relative to the second body. In addition, the cushion pads disposed near the pivot members may decrease wearing of the lateral walls of the first body and the second body when the second body rotates relative to the first body.

BRIEF DESCRIPTION OF THE DRAWINGS

The disclosure can be more fully understood by reading the following detailed description of the embodiment, with reference made to the accompanying drawings as follows.

DETAILED DESCRIPTION

Figure 1:
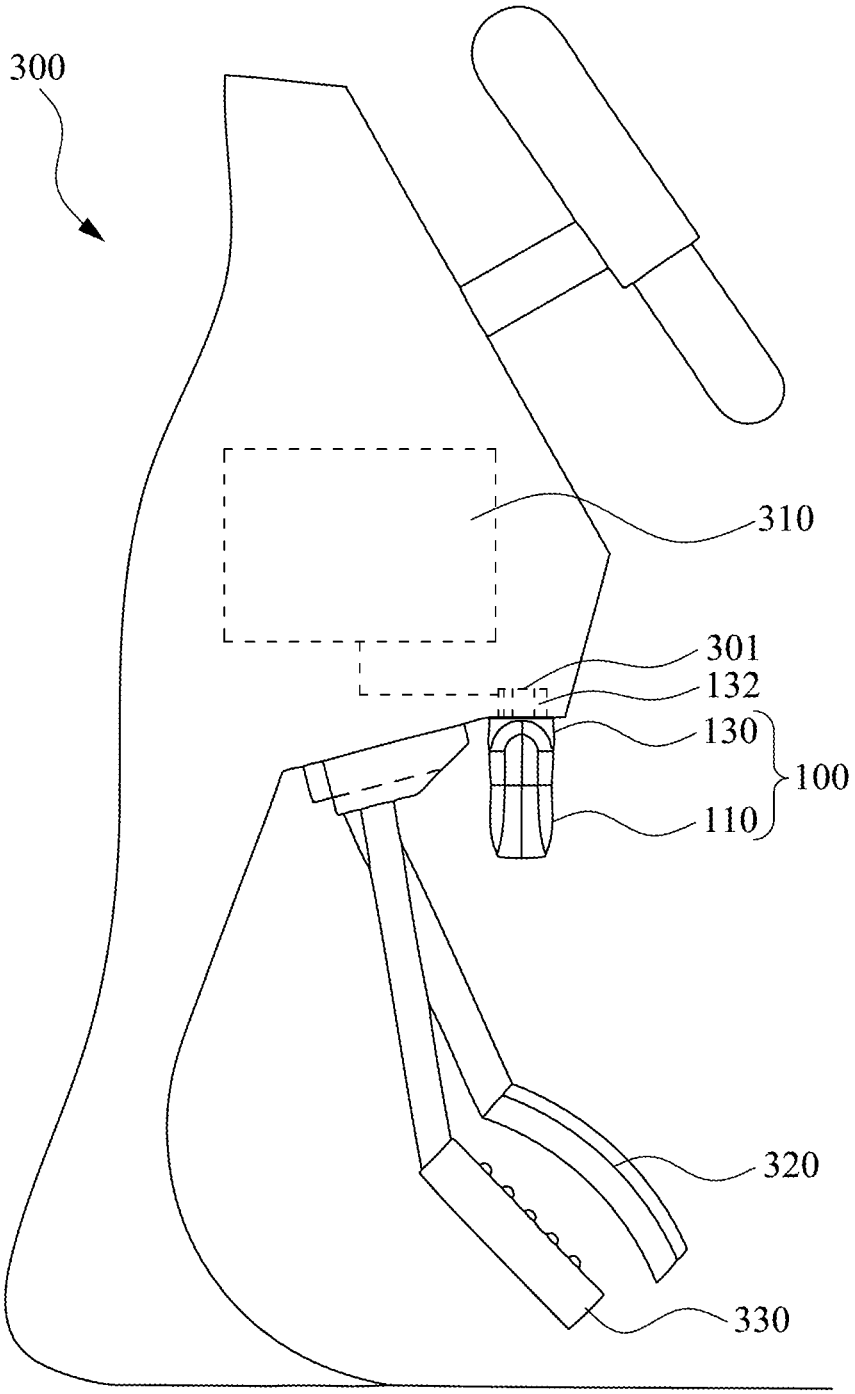
FIG. 1 illustrates a schematic diagram of a data acquisition device connected to a vehicle body according to an embodiment of the present invention is applied.

Reference will now be made in detail to the present embodiments of the disclosure, examples of which are illustrated in the accompanying drawings. Wherever possible, the same reference numbers are used in the drawings and the description to refer to the same or like parts.

FIG. 1 shows a schematic diagram of a data acquisition device 100 connected to a vehicle body 300 according to an embodiment of the present invention is applied. The data acquisition device 100 includes a first body 110 and a second body 130. When the first body 110 is connected with the second body 130, the first body 110 is capable of rotating relative to the second body 130. The second body 130 has a plug part 132, and the plug part 132 of the second body 130 is, but not limited to, put into a socket 301 of the vehicle body 300 such that the second body 130 is electrically connected to the vehicle body 300 to be received electric power and vehicle information from a mainframe 310 of the vehicle body 300. In this embodiment, the data acquisition device 100 may be, but not limited to, disposed in front of a driver's seat of the vehicle body 300 near a throttle pedal 320 or a brake pedal 330. In addition, when the data acquisition device 100 is connected to the vehicle body 300, a rotatable angle between the first body 110 and the second body 120 may be adjusted according to requirements of a user. In this embodiment, the plug part 132 is, but not limited to, adapted for an on-board diagnostics (OBD) system or an on-board diagnostics 2 (OBD 2) system.

Figure 2:
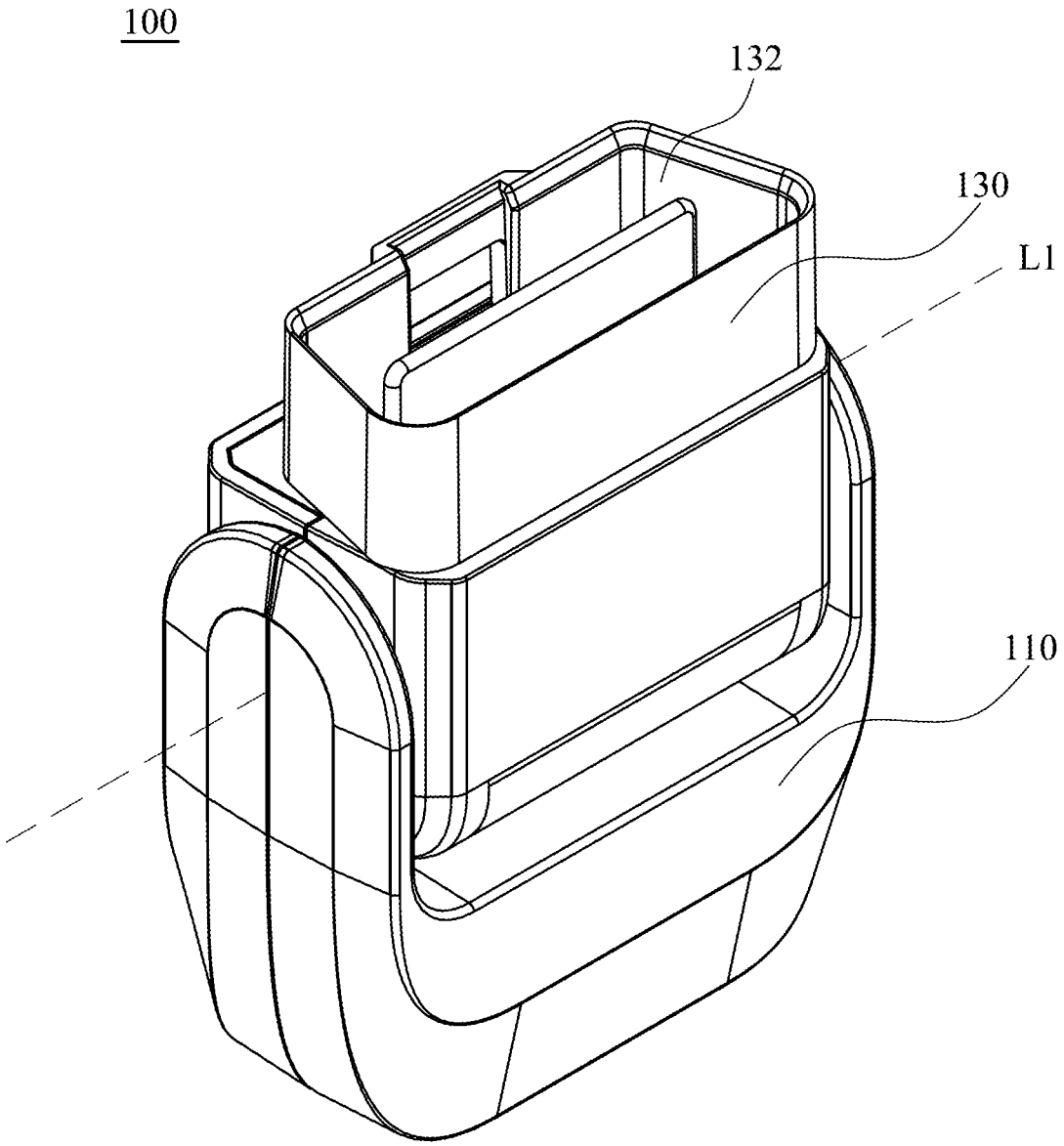
FIG. 2 illustrates a schematic diagram of the data acquisition device according to an embodiment of the present invention is applied.
Figure 3A:
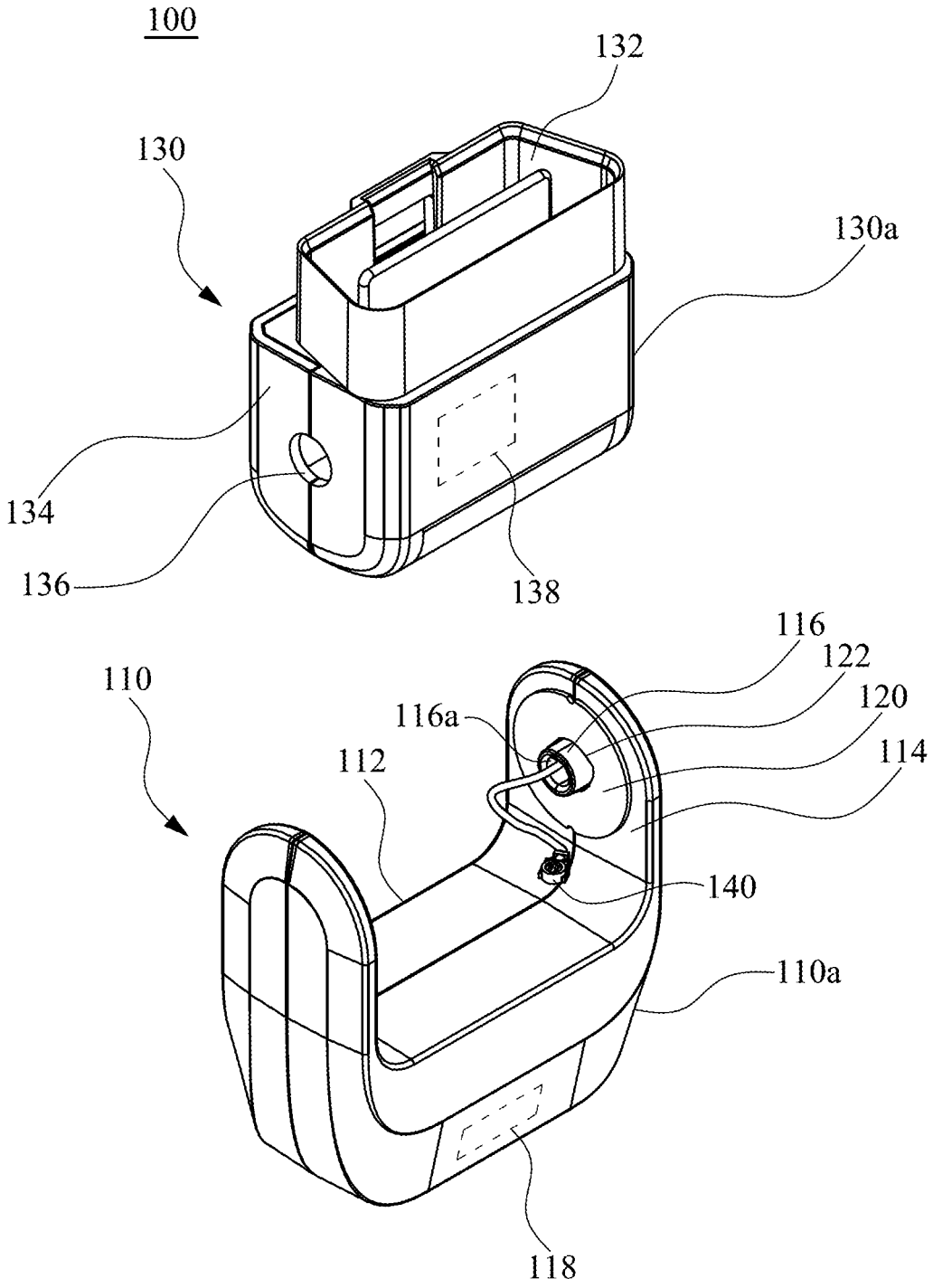
FIG. 3A illustrates an exploded view of the data acquisition device of FIG. 2.
Figure 3B:
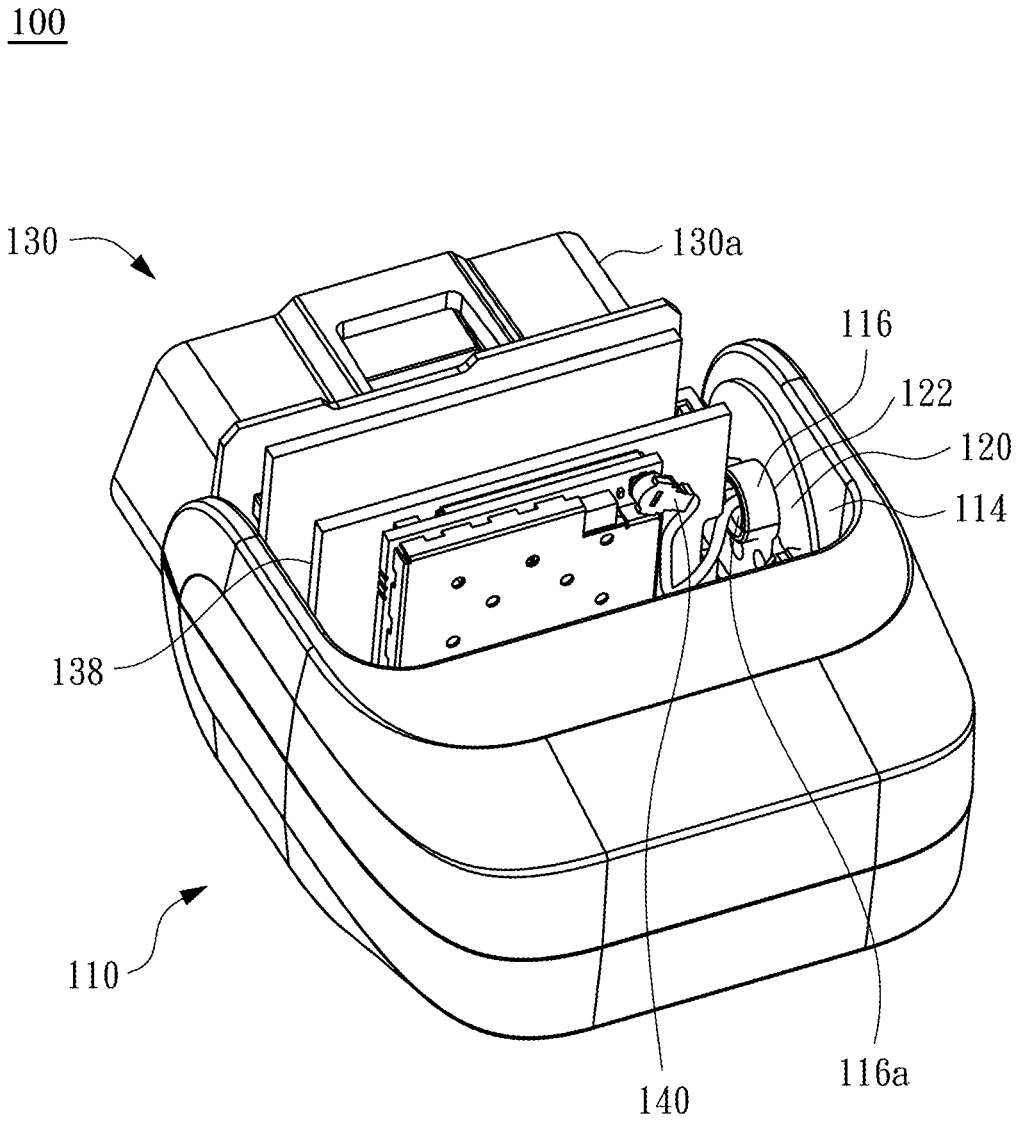
FIG. 3B illustrates a partial schematic diagram of the data acquisition device of FIG. 2.

FIG. 2 shows a schematic diagram of the data acquisition device 100 according to an embodiment of the present invention is applied, and FIG. 3A shows an exploded view of the data acquisition device 100 of FIG. 2. FIG. 3B illustrates a partial schematic diagram of the data acquisition device 100 of FIG. 2. The first body 110 is connected with the second body 130 to form the data acquisition device 100.

The first body 110 includes a first casing 110*a*, an antenna member 118, and two cushion pads 120. A terminal of the first casing 110*a* forms a recession 112 and two lateral walls 114 of the recession 112 have two pivot members 116. One of the pivot members 116 is hollow and has a passage 116*a*. The passage 116*a* is communicated with the inner space of the first casing 110*a*. The antenna member 118 is disposed in the first casing 110*a* for processing a wireless signal. The two cushion pads 120 are respectively located on the two lateral walls 114 of the recession 112 and circumferentially disposed around the two pivot members 116. However, each of the cushion pads 120 has a core hole 122 and the pivot members 116 are respectively passing through the core holes 122. In this embodiment, the first casing 110*a* is, but not limited to, a plastic casing. Each of the cushion pads 120 is, but not limited to, a rubber cushion pad or a silicon rubber cushion pad, and each of the cushion pads 120 is, but not limited to, formed in manner of dual injection molding. In addition, the antenna member 118 is, but not limited to, a laser direct structure (LDS) antenna member.

The second body 130 includes a second casing 130*a* and a process device 138. A terminal of the second casing 130*a* has the plug part 132 for being connected to the vehicle body 300 (seeing FIG. 1), and two lateral walls 134 of the second casing 130*a* respectively have two pivot holes 136 for being pivoted on the two pivot members 116 such that the second casing 130*a* is capable of rotating along an axis L1. In other words, two pivot holes 136 may be pivoted on the two pivot members 116 such that the second casing 130*a* is capable of rotating relative to the first casing 110*a* along an axis L1. The passage 116*a* of the pivot members 116 is communicated with the inner space of the second casing 130*a* via the corresponding pivot hole 136. In this embodiment, the second casing 130*a* may be, but not limited to, a plastic casing. In addition, the processing device 138 is disposed in the second casing 130*a* for being electrically connected to the antenna member 118 and the vehicle body 300 (seeing FIG. 1). In detail, the data acquisition device 100 further includes a coaxial cable connector 140 passing into the first casing 110*a* and the second casing 130*a* via the passage 116*a* and the pivot hole 136, and thus provides an electrical connection between the antenna member 118 in the first casing 110*a* and the processing device 138 in the second casing 130*a*. The processing device 138 may, but be not limited to, have several functions such as locating by GPS, communicating, processing vehicle information, etc. In addition, when the first body 110 is electrically connected to the vehicle body 300 (seeing FIG. 1), the processing device 138 may be read the information of the mainframe 310 (seeing FIG. 1) such as a mileage of the vehicle body 300 (seeing FIG. 1) or a traveling speed of the vehicle body 300. In this embodiment, each of the cushion pads 120 is, but not limited to, combined with the second casing 130*a* in a manner of dual injection molding.

When the pivot members 116 of the first body 110 are coupled with the pivot holes 136 of the second body 130 such that the second body 130 is capable of rotating relative to the first body 110 along an axis L1, the angle between the first body 110 and the second body 120 may be adjusted according to the user demand such that the first body 110 and the second body 130 may not retard the user action when the user is driving and the antenna member 118 may have good performance. When the first body 110 is connected with the second body 130, the cushion pads 120 disposed around the pivot members 116 may decrease wearing of the lateral walls 114 of the first body 110 and wearing of the lateral walls 134 of the second body 130 and noise of rotating when the second body 120 rotates relative to the first body 110 because of the material characteristics of the cushion pads 120.

Figure 4:
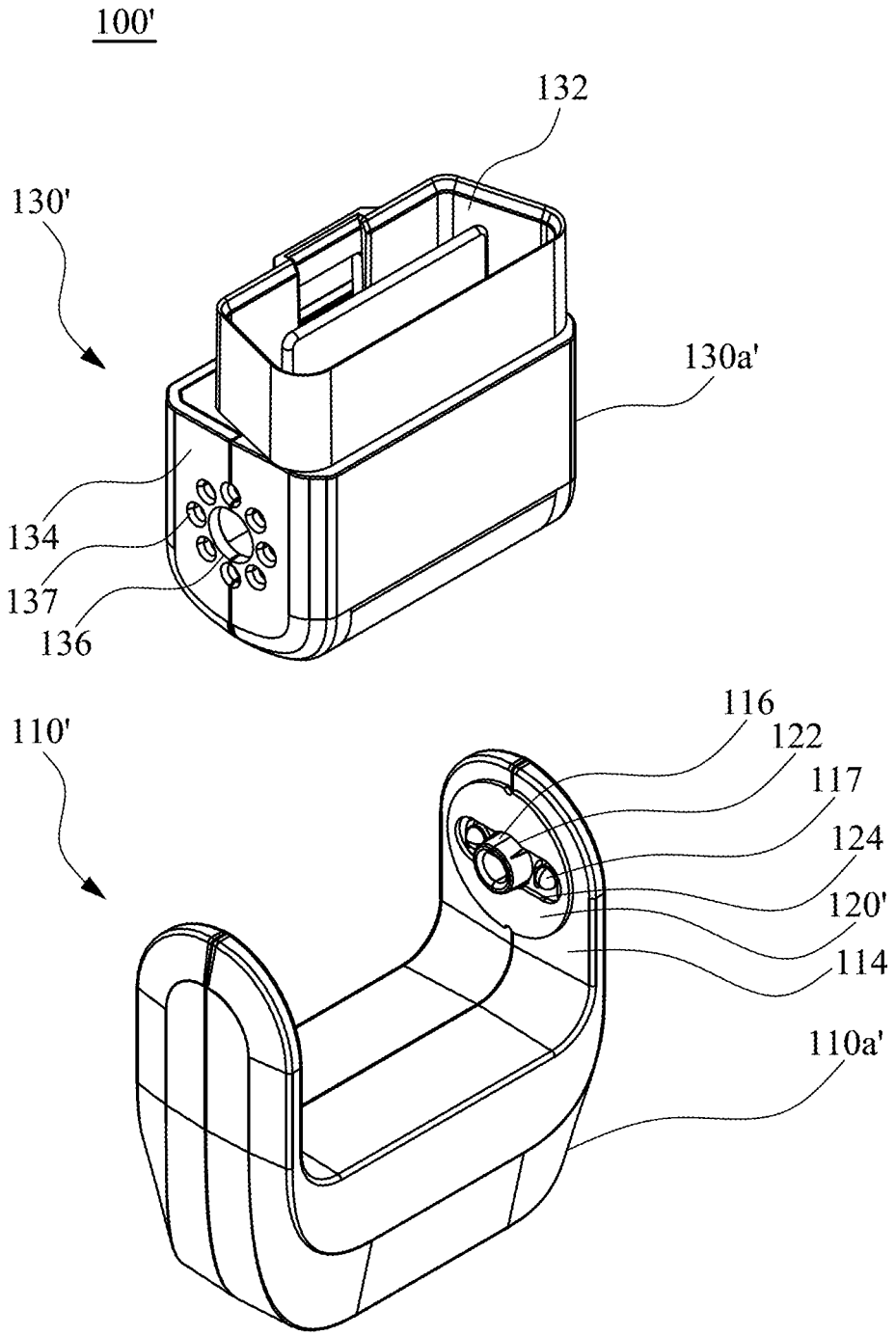
FIG. 4 illustrates an exploded view of the data acquisition device according to another embodiment of the present invention is applied.

FIG. 4 shows an exploded view of the data acquisition device 100' according to another embodiment of the present invention is applied. The lateral walls 134 of the second casing 130*a'* of the second body 130' has several locating holes 137 and the locating holes 137 are, but not limited to, circumferentially disposed around the two pivot holes 136. The lateral walls 114 of the first casing 110*a'* of the first body 110' has several locating members 117 and the locating members 117 are circumferentially disposed around the two pivot members 116. The locating members 117 are rotatably connected with the pivot holes 137 of the second body 130' when the second body 130' rotates relative to the first body 110'. In this embodiment, each of the cushion pads 120' connected to one of the lateral walls 114 of the first casing 110*a'* has several through holes 124 circumferentially disposed around the core hole 122 such that the locating members 117 pass through the through holes 124. In this embodiment, number of the locating members 117 is, but not limited to, two, and number of the through holes 124 is, but not limited to, two.

When the first body 110' rotates relative to the second body 130' to form an angle between the first body 110' and the second body 130', the locating members 117 are correspondingly coupled with the locating holes 137 to locate the angle. Because the cushion pads 120' disposed around the pivot members 116 is simultaneously contacted to the lateral walls 114 of the first casing 110*a* and the lateral walls 134 of the second casing 130*a*', the cushion pads 120 may decrease the wearing of the lateral walls 114 of the first body 110' and the wearing of the lateral walls 134 of the second body 130' and the noise of rotating when the second body 130' rotates relative to the first body 110'.

Figure 5:
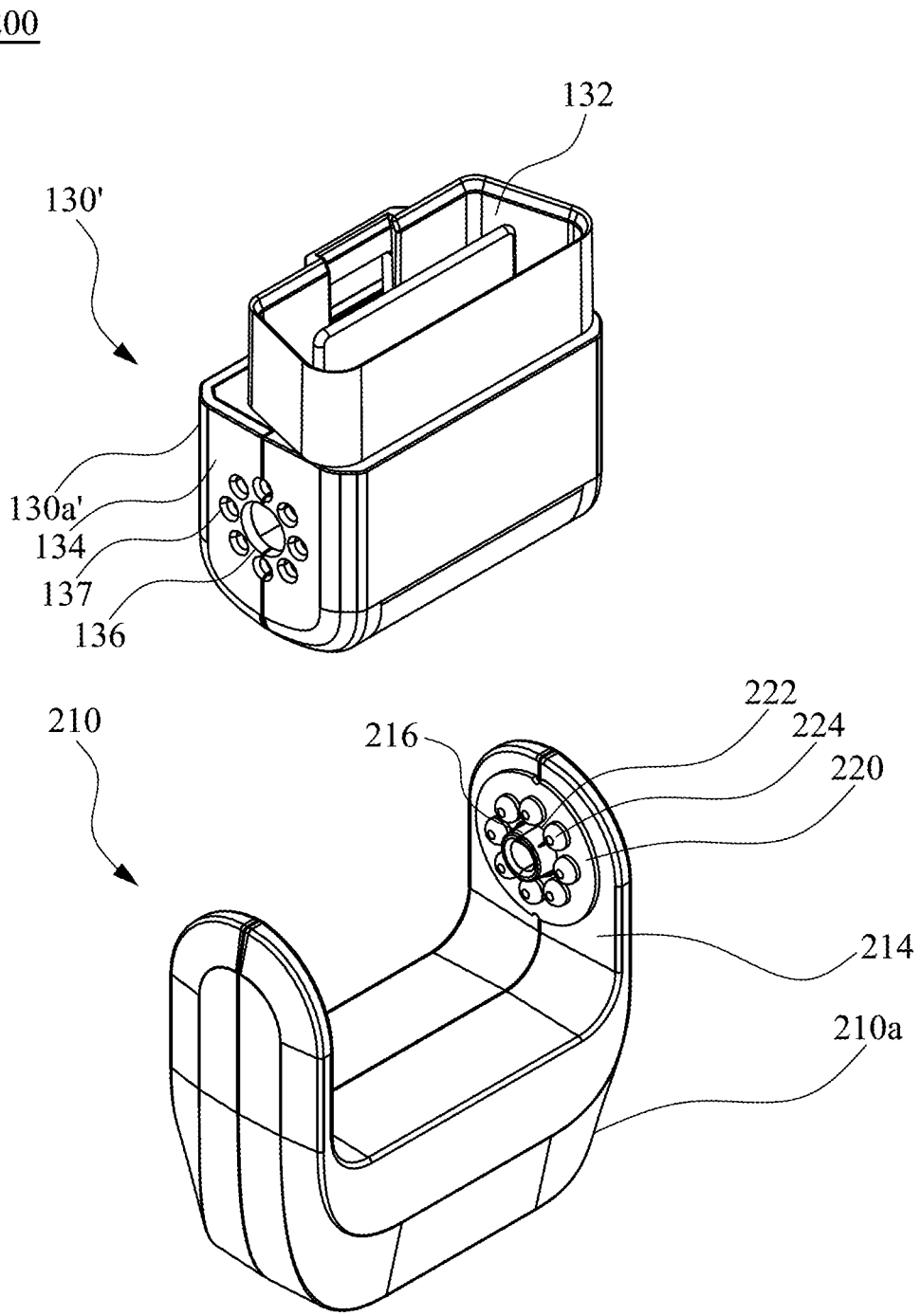
FIG. 5 illustrates an exploded view of the data acquisition device according to another embodiment of the present invention is applied.

FIG. 5 shows an exploded view of the data acquisition device 200 according to another embodiment of the present invention is applied. In this embodiment, the lateral walls 134 of the second casing 130*a*' of the second body 130' may, but be not limited to, have several locating holes 137 and the locating holes 137 are circumferentially disposed around the two pivot holes 136. The cushion pads 220 of the first body 210 have several cushion-locating members 224, and the cushion-locating members 224 are circumferentially disposed around the core holes 222 of the cushion pads 220. When the first body 210 rotates relative to the second body 130', the cushion-locating members 224 may be rotatably connected with the locating holes 137 of the second casing 130*a'*.

When the first body 210 rotates relative to the second body 130' to form an angle between the first body 210 and the second body 130', the cushion-locating members 224 are correspondingly coupled with the locating holes 137 such that the angle between the first body 210 and the second body 130' may be located. Because the cushion pads 220 disposed around the pivot members 216 is simultaneously contacted to the lateral walls 214 of the first casing 210*a* and the lateral walls 134 of the second casing 130*a*', the cushion pads 120 may decrease the wearing of the lateral walls 214 of the first body 210' and the wearing of the lateral walls 134 of the second body 130' and the noise of rotating when the second body 130' rotates relative to the first body 210'.

According to above-described embodiments, the data acquisition device has several advantages as followings:

(1) When the plug part of the second body is coupled with the vehicle body, a rotatable angle between the first body and the second body may be adjusted according to a user demand.

(2) The cushion pads circumferentially disposed near the pivot members may serve the cushion to against the shock when the vehicle body is driven and to lower the noise when the first body rotates relative to the second body.

(3) The cushion pads disposed near the pivot members may decrease wearing of the lateral walls of the first body and the lateral walls of the second body when the second body rotates relative to the first body.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A data acquisition device for a vehicle, comprising:

a first body comprising:

a first casing, and a terminal of the first casing forming a recession, and two lateral walls of the recession having two pivot members, wherein one of the pivot members is hollow and has a passage;

an antenna member disposed in the first casing for processing a wireless signal; and two cushion pads respectively located on the two lateral walls of the recession and circumferentially disposed around the two pivot members, and each of the cushion pads having a core hole, and the pivot members respectively passing through the core holes; and a second body comprising:

a second casing, and a terminal of the second casing having a plug part for being connected to an vehicle body and two lateral walls of the second casing respectively having two pivot holes for being pivoted on the two pivot members such that the second casing is capable of rotating along an axis, wherein the passage is communicated with the inner space of the second casing via the corresponding pivot hole; and a processing device disposed in the second casing for being electrically connected to the antenna member and the vehicle body.

2. The data acquisition device of claim 1, wherein the second casing has a locating hole circumferentially disposed around the two pivot holes, and the first casing has a locating member circumferentially disposed around the two pivot members for being rotatably connected with the pivot holes.

3. The data acquisition device of claim 2, wherein each of the cushion pads has a plurality of through holes circumferentially disposed around the core hole such that the locating members pass through the through holes.

4. The data acquisition device of claim 1, wherein the cushion pads have a plurality of cushion-locating members circumferentially disposed around the core holes for being connected with the locating holes.

5. The data acquisition device of claim 1, wherein each of the cushion pads is a rubber cushion pad or a silicon rubber cushion pad.

6. The data acquisition device of claim 1, wherein each of the cushion pads is combined with the second casing in a manner of dual injection molding.

7. The data acquisition device of claim 1, wherein the first casing is a plastic casing.

8. The data acquisition device of claim 1, wherein the second casing is a plastic casing.

9. The data acquisition device of claim 1, wherein the plug part is adapted for an on-board diagnostics (OBD) system or an on-board diagnostics 2 (OBD 2) system.

10. The data acquisition device of claim 1, wherein the antenna member is a laser direct structure (LDS) antenna member.

* * * * *